US009416650B2

(12) United States Patent
Hallundbæk

(10) Patent No.: US 9,416,650 B2
(45) Date of Patent: Aug. 16, 2016

(54) DOWNHOLE TOOL WITH THERMALLY INSULATED ELECTRONICS MODULE

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 245 days.

(21) Appl. No.: 14/114,611

(22) PCT Filed: Apr. 27, 2012

(86) PCT No.: PCT/EP2012/057803

§ 371 (c)(1),
(2), (4) Date: Oct. 29, 2013

(87) PCT Pub. No.: WO2012/146733

PCT Pub. Date: Nov. 1, 2012

(65) Prior Publication Data

US 2014/0076531 A1 Mar. 20, 2014

(30) Foreign Application Priority Data

Apr. 29, 2011 (EP) ..... 11164293

(51) Int. Cl.
*E21B 47/01* (2012.01)

(52) U.S. Cl.
CPC ..... *E21B 47/011* (2013.01)

(58) Field of Classification Search
CPC ... E21B 36/003; E21B 41/0085; E21B 47/01; E21B 47/011
See application file for complete search history.

(56) References Cited

U.S. PATENT DOCUMENTS

| | | | |
|---|---|---|---|
| 4,407,136 | A | 10/1983 | De Kanter |
| 5,878,824 | A | 3/1999 | Mercer et al. |
| 7,440,283 | B1 | 10/2008 | Rafie |
| 2004/0264543 | A1 | 12/2004 | Storm et al. |
| 2005/0150691 | A1 | 7/2005 | Schultz et al. |
| 2007/0095096 | A1 | 5/2007 | DiFoggio et al. |
| 2008/0047751 | A1 | 2/2008 | Yamate et al. |
| 2011/0017454 | A1 | 1/2011 | Sanderlin et al. |

FOREIGN PATENT DOCUMENTS

| | | | |
|---|---|---|---|
| CN | 101066010 | A | 10/2007 |
| CN | 101328800 | A | 12/2008 |
| CN | 101328801 | A | 12/2008 |
| RU | 2406282 | C1 | 10/2010 |

OTHER PUBLICATIONS

International Search Report for PCT/EP2012/057803, mailed Jun. 22, 2012.

International Preliminary Report on Patentability issued in International Patent Application No. PCT/EP2012/057803 dated Oct. 29, 2013.

Office Action dated Apr. 6, 2016 issued in Russian Application No. 2013152079/03 with English translation (8 pages).

Office Action dated Sep. 29, 2015 issued in Chinese Application No. 201280021005.1 with English translation (11 pages).

*Primary Examiner* — Catherine Loikith
(74) *Attorney, Agent, or Firm* — Nixon & Vanderhye P.C.

(57) ABSTRACT

The present invention relates to a downhole tool comprising a tool housing, an electronics assembly comprising an electronic module located within the housing, wherein the electronics assembly further comprises a plurality of transistor elements being electrically connected with the electronic module and being arranged on a thermal member which is thermally connected with the housing, wherein the electronic module is thermally insulated from the thermal member. Furthermore, the invention relates to a downhole system comprising a wireline, a tool string, and a downhole tool according to the invention.

15 Claims, 4 Drawing Sheets

DOWNHOLE TOOL WITH THERMALLY INSULATED ELECTRONICS MODULE

This application is the U.S. national phase of International Application No. PCT/EP2012/057803 filed 27 Apr. 2012 which designated the U.S. and claims priority to EP Patent Application No. 1116429.0 filed 29 Apr. 2011, the entire contents of each of which are hereby incorporated by reference.

FIELD OF THE INVENTION

The present invention relates to a downhole tool comprising an electronics assembly comprising transistor elements for a downhole tool.

BACKGROUND ART

Downhole electronics, which are employed in the control systems for production of hydrocarbon fluid in extraction wells, contain electronic power supplies and components such as transistors that in use generate a substantial amount of heat. The current requirement for more sophistication in the control and monitoring of downhole tools in hydrocarbon wells has resulted in a significant increase in power requirement, which creates the problem of having to remove the heat to sustain sensible operating temperatures. Removal of heat is dependent on its transfer to the housing, but due to the elevated temperatures when working downhole, the electronics of the tools are typically thermally insulated from the housing to protect the electronic components from elevated temperatures. Therefore, the heat generating components such as transistors may potentially overheat or cause other components to overheat. Furthermore, transistors may suffer from a so-called thermal runaway, which is a transistor starting to heat up, thereby dissipating more and more heat due to the increased temperature, which then escalates the problem, which further increases a need for protecting transistors and other electronic components adjacent to transistor elements from obtaining elevated temperatures.

SUMMARY OF THE INVENTION

It is an object of the present invention to wholly or partly overcome the above disadvantages and drawbacks of the prior art. More specifically, it is an object to provide an improved electronics assembly with the ability to operate under increased ambient temperatures in a downhole environment without the use of active cooling such as liquid cooling, which for downhole equipment represents a series of other and typically far worse technical problems.

The above objects, together with numerous other objects, advantages, and features, which will become evident from the below description, are accomplished by a solution in accordance with the present invention by a downhole tool comprising:

a tool housing, and an electronics assembly comprising:

an electronic module located within the housing, wherein the electronics assembly further comprises a plurality of transistor elements being electrically connected with the electronic module and being arranged on a thermal member which is thermally connected with the housing, wherein the electronic module is thermally insulated from the thermal member.

Also, the present invention relates to a downhole tool comprising:

a tool housing, and an electronics assembly comprising:

an electronic module located within the housing, wherein the electronics assembly further comprises a plurality of transistor elements being electrically connected with the electronic module and being arranged on a thermal member in direct connection with the housing.

In one embodiment, the thermal member may be a solid protrusion of the housing.

Furthermore, the electronic module may be thermally insulated from the thermal member.

Also, the electronic module may be connected to the housing and the transistors may be connected to the thermal member.

In another embodiment, the housing may be a heat sink for the plurality of transistor elements.

In yet another embodiment, a mating tool of the downhole tool comprising the electronics assembly may be a heat sink for the plurality of transistor elements.

In addition, the thermal member may further comprise a compartment containing a heat absorption material with a melting point below a critical breakdown temperature of the plurality of transistor elements for providing an extra latent heat of fusion fail-safe protection against temperatures above the melting point of the heat absorption material.

Moreover, the plurality of transistor elements may be electrically insulated but thermally connected to the thermal member through a plurality of insulation members.

Further, the thermal member may comprise a compartment containing an active cooling element such as a vapour compression refrigeration element, a magnetic cooling element, an evaporative cooling element or a thermoelectric cooling element.

The downhole tool comprising an electronics assembly according to the invention may further comprise one or more operational units being a logging unit, such as a thermal probe, an image generating unit, a measuring unit, such as a flow velocity measuring unit, a positioning unit, such as a casing collar locator, or similar operational unit.

Additionally, the downhole tool comprising an electronics assembly according to the invention may further comprise a pump or a cleaning unit.

The present invention further relates to a downhole system comprising:

a wireline, a tool string, and a downhole tool according to the invention.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
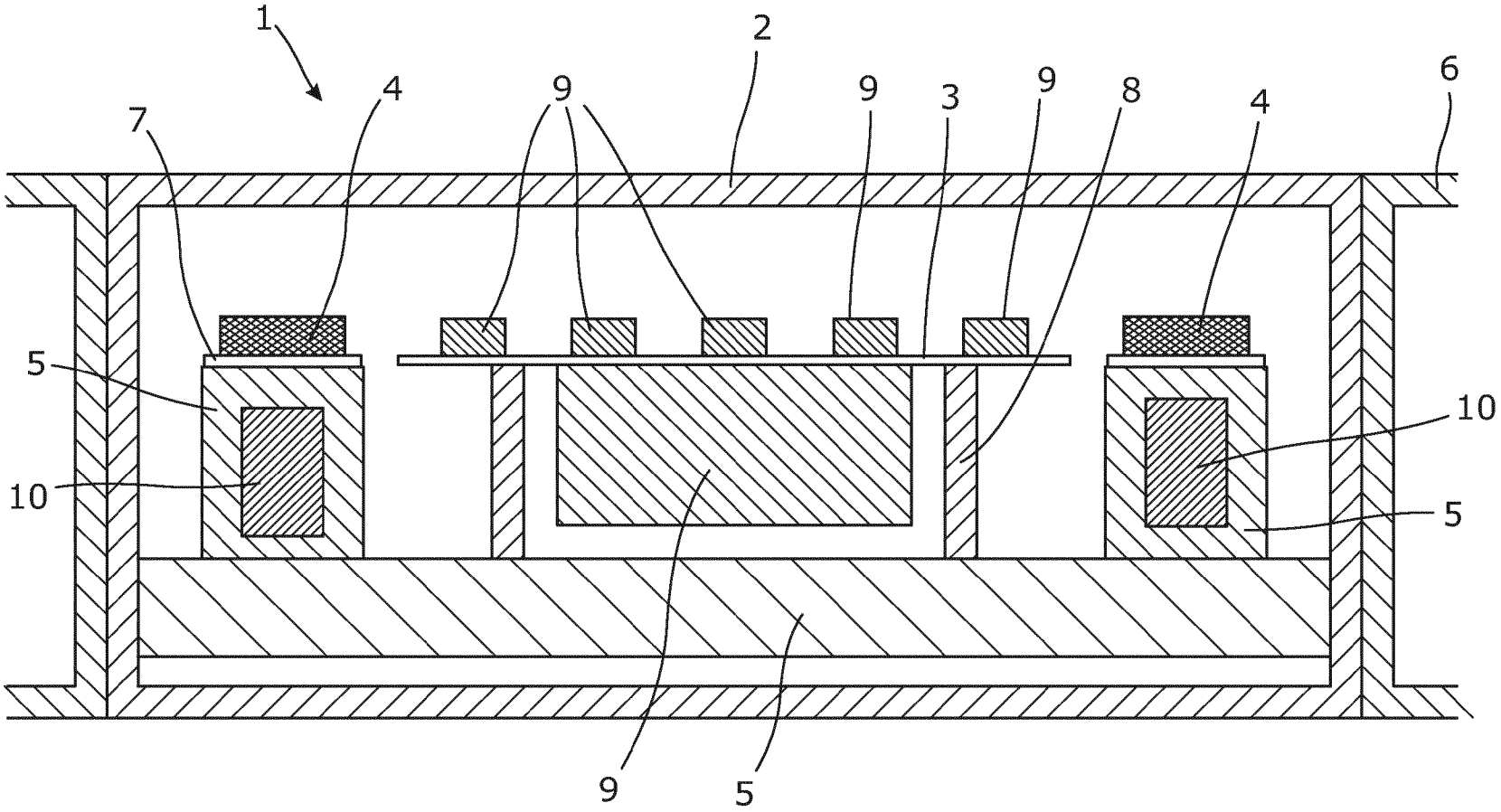
FIG. 1 shows a cross-sectional view of an electronics assembly.
Figure 5:
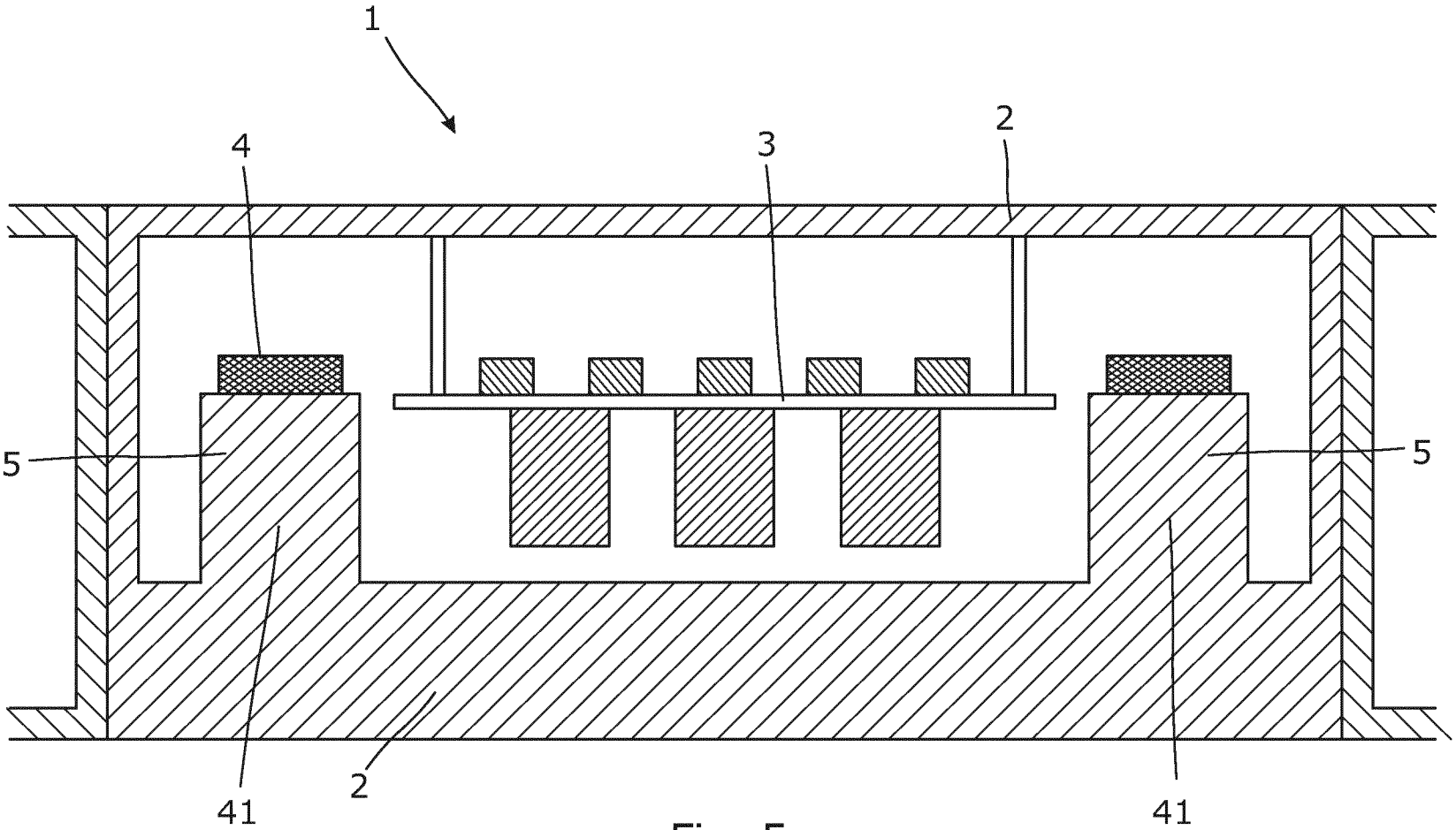
FIG. 5 is a cross-sectional view of an electronics assembly.

FIG. 1 shows an electronics assembly 1 for use in a downhole tool 100. A hollow tool housing 2 comprises an electronic module 3 and a plurality of transistor elements 4. The transistor elements 4 are arranged on a thermal member 5 for dissipating heat generated by the transistor elements 4 directly to the tool housing 2 and/or further away to a mating tool 6 of the downhole tool 100 comprising the electronics assembly 1. In some embodiments, the electronic module 3 is mounted on the thermal member 5, as shown in FIG. 1, and in other embodiments the electronic module is mounted on the thermal member 5 being part of the tool housing 2, as shown in FIG. 5. The electronic module 3 may be mounted with mounting means 8 having a specific thermal conductance designed to meet certain thermal requirements of specific electronic elements 9 comprised in the electronic module 3. If the requirements for thermal conductance are high in order to expel heat from the electronic module 3, a material of high thermal conductance is chosen for the mounting means 8. If on the other hand the requirements for thermal conductance are low, a thermally insulating material may be chosen. Typically, transistor elements are the primary heat generating electronic components in an electronic assembly. However, other heat generating electronic components may also be thermally separated from the electronic module and arranged on the thermal member in electrical connection with the electronic module.

Figure 2:
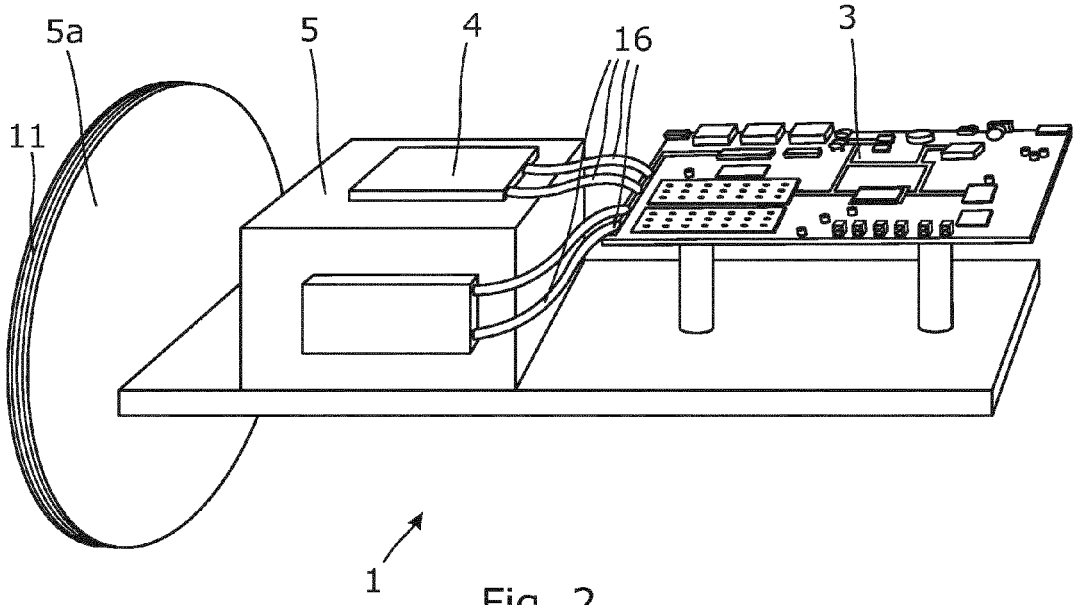
FIG. 2 is a perspective view of thermal member and an electronic module.

FIG. 2 shows a close-up perspective view of the thermal member 5. As shown, the thermal member 5 may have a circular end member 5*a* to accommodate mounting in a cylindrically shaped downhole tool 100, which is the most typical shape for downhole tools.

Figure 3:
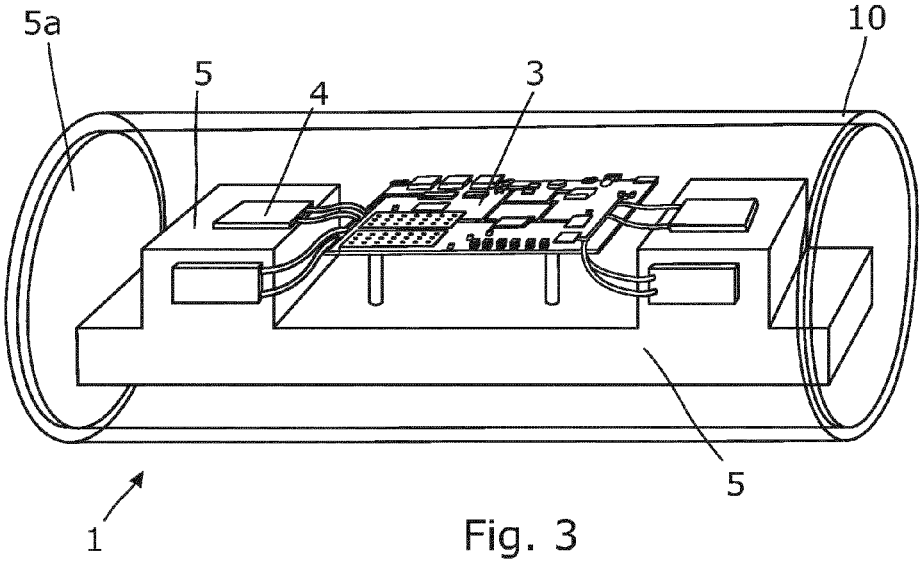
FIG. 3 is a perspective view of an electronic module, some parts being presented transparently for illustrative purposes.

FIG. 3 shows a perspective view of an electronics assembly 1. Typically all downhole tools 100 are fitted into cylindrical housings to optimise the special spacial requirements when working downhole in a borehole. In order to optimise the thermal dissipation away from the thermal member 5, the thermal member may comprise an end member 5*a* with good thermally conducting properties such that when being in direct contact with the tool housing 2 as shown in FIG. 3, heat is effectively dissipated to the tool housing and/or to the mating tool 6 shown FIGS. 1 and 4. Furthermore, the end member 5*a* may comprise attachment means 11, such as threads, for fixating the electronics assembly 1 in the tool housing 2.

Figure 4:
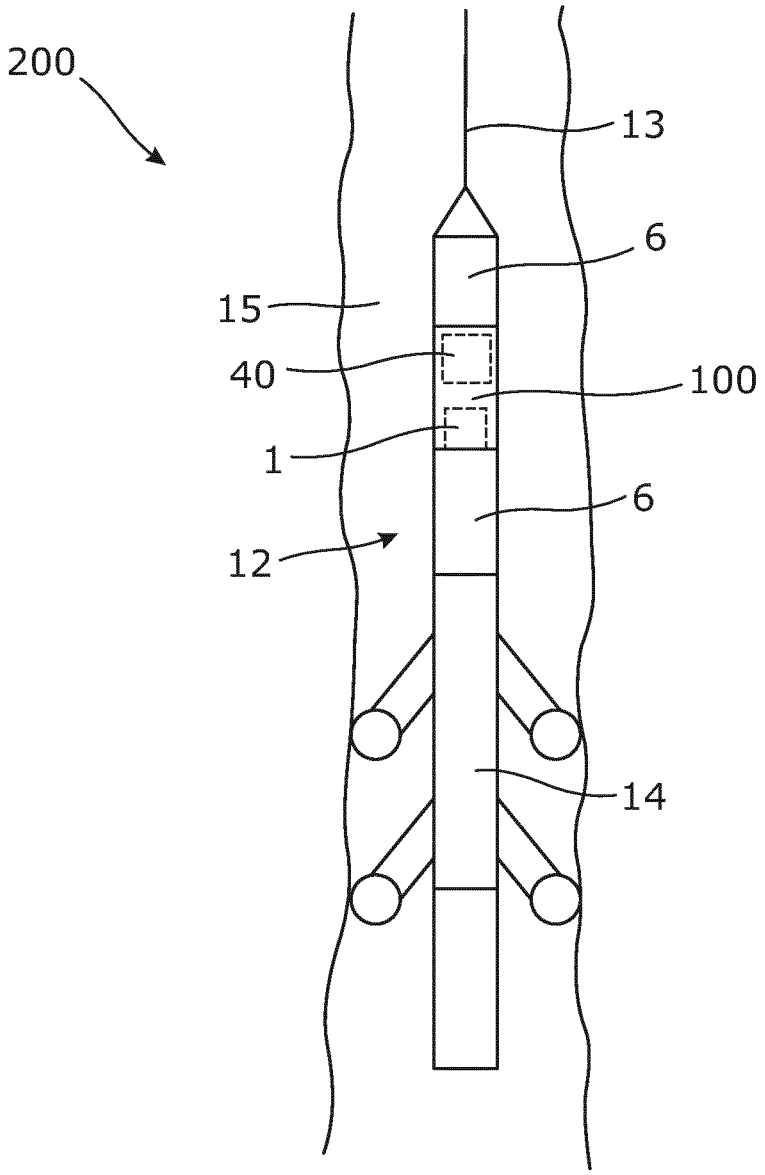
FIG. 4 is a schematic view of a tool string.

FIG. 4 shows a downhole system 200 comprising a tool string 12, a wireline 13, a plurality of mating tools 6 and a downhole tool 100 comprising the electronics assembly 1. The tool string 12 may be propelled in the borehole 15 by a driving section 14 of a downhole tractor and retracted by the wireline 13. The total may include one or more operation units 40.

Waste heat is produced in transistors due to the current flowing through them. If a transistor becomes too hot, it needs to be cooled or it may, in the worst case, be destroyed by the heat. The thermal member 5 helps to dissipate the heat by transferring heat away from the transistor elements 4.

Use of thermal members 5 enables the downhole tool to enter wells or boreholes 15 having an ambient temperature of more than 25 degrees such as preferably more than 50 degrees higher than if the transistors were not arranged on a thermal member 5 in direct connection with the housing. Enabling the tool string 12 comprising an electronics assembly with transistor elements 4 to operate at elevated temperatures is crucial when working in a downhole environment. Local temperature changes in the earth crust, such as in the vicinity of magma, may cause destruction of electronic elements such as transistors. Therefore, increased ability to resist elevated temperatures is very valuable in downhole operations. Furthermore, downhole equipment has the general problem that it is very compact due to the spacial requirements and that it is in close proximity to the surroundings, both leading to difficulties in expelling heat during operation.

Thermal grease may be utilised in order to obtain a good thermal conductance between the transistor elements 4 and the thermal member 5. Additionally or alternatively to thermal grease, the transistors may be clamped towards the surface of the thermal member 5 again to ensure good thermal contact and thereby good thermal conductance.

The thermal member 5 may advantageously be made from high thermal conductance material such as a metal such as aluminium. However, since metals are also electrical conductors, the transistors may short wire through the thermal member 5, if they are in direct contact, leading to breakdown of the transistors. Therefore, the transistor elements 4 and the thermal members 5 are typically separated by an insulating member 7 as shown in FIG. 1, which has to be a relatively good thermal conductor but a very poor electrical conductor, such as a an aluminium oxide.

As shown in FIG. 1, the thermal member 5 may comprise a compartment 10 containing a heat absorption material with a melting point below a critical breakdown temperature of the plurality of transistors for providing an extra latent heat of fusion fail-safe protection against temperatures above the melting point of the heat absorption material. Having the compartment 10 containing a heat absorption material ensures that when the temperature of the thermal member 5 exceeds the melting temperature of the heat absorption material, the heat absorption material will absorb the extra heat in the latent heat of fusion or so-called melting energy in order to melt the material without further increasing the temperature, thereby providing a temperature limitation of the thermal member 5 until the heat absorption material is entirely melted. The transistor elements 4 are electrically connected with the electronic module 3 by electrical wires 16.

Alternatively, the compartment 10 may contain an active cooling element. Active cooling elements may be provided by well-known cooling systems such as vapour compression refrigeration, magnetic cooling, evaporative cooling, thermoelectric cooling or other cooling techniques. Also combinations of passive and active cooling elements in the compartment may be used to prevent temperatures of the electronic elements in the electronic assembly from exceeding critical temperatures.

By providing passive or active cooling in the thermal member, fail-safe operation of the electronic assembly may be ensured. Also, wear of the electronic components used in the electronic assembly due to elevated temperatures is diminished.

Depending on various parameters such as available power, available space, required cooling capacity etc., specific active cooling elements may have advantages such as e.g. thermoelectric cooling if space is very limited and power is available, which is normally the case in downhole equipment.

As shown in FIG. 5, the thermal member 5 is a solid protrusion 41 of the tool housing 2. FIG. 5 shows the thermal member 5 attached to the housing, but alternatively the thermal member may be an integral part of the housing, which may improve heat transfer but seriously challenge the construction of the housing.

As also shown in FIG. 5, the electronic module 3 is attached to the tool housing 2 and the transistor elements 4 are attached to the thermal member 5 thereby enhancing the thermal decoupling of electronic module 3 and transistor elements 4.

FIG. 2 shows a close-up perspective view of the thermal member 5. As shown, the thermal member 5 may have a circular end member 5*a* to accommodate mounting in a cylindrically shaped downhole tool which is the most typical shape for downhole tools.

The thermal member 5 may be made from a highly thermally conductive material such as preferably a metal, such as preferably aluminium.

The thermal member 5 may also act as a heat sink to absorb excessive heat and not only transfer the heat away from the transistor elements 4. The housing serves as a heat sink interacting with the surrounding well fluid in the borehole 15 or the casing in the event of a cased completion.

Transistor elements 4 need thermal stabilisation because the operating point of a transistor junction, similar to a diode, is affected by temperature. In fact, this can cause thermal runaway, and device destruction, if the design does not account for this.

A direct connection will, in the present application, be considered to be a connection between solid members. Even if the connection between two solid members may be enhanced by a liquid thermal grease or the like, the connection is still considered to be a direct connection.

Although the invention has been described in the above in connection with preferred embodiments of the invention, it will be evident for a person skilled in the art that several modifications are conceivable without departing from the invention as defined by the following claims.

The invention claimed is:

1. A downhole tool comprising:

a tool housing, and an electronics assembly comprising:

an electronic module located within the housing, the electronic module having a plurality of electronic components, wherein the electronics assembly further comprises a plurality of transistor elements being electrically connected with the electronic module and being arranged on a thermal member which is thermally connected and in direct connection with the housing, wherein the electronic components of the electronic module are thermally insulated from the transistor elements mounted on the thermal member.

2. The downhole tool according to claim 1, wherein the thermal member is a solid protrusion of the housing.

3. The downhole tool according to claim 2, wherein the electronic module is connected to the housing and the plurality of transistor elements are connected to the thermal member.

4. The downhole tool according to claim 1, wherein the housing is a heat sink for the plurality of transistor elements.

5. The downhole tool according to claim 1, wherein a mating tool of the downhole tool comprising the electronics assembly is a heat sink for the plurality of transistor elements.

6. The downhole tool according to claim 1, wherein the thermal member further comprises a compartment containing a heat absorption material with a melting point below a critical breakdown temperature of the plurality of transistor elements for providing an extra latent heat of fusion fail-safe protection against temperatures above the melting point of the heat absorption material.

7. The downhole tool according to claim 1, wherein the thermal member further comprises a compartment containing an active cooling element.

8. The downhole tool according to claim 1, wherein the plurality of transistor elements are electrically insulated but thermally connected to the thermal member through a plurality of insulation members.

9. The downhole tool comprising an electronics assembly according to claim 1, further comprising one or more operational units.

10. The downhole tool comprising an electronics assembly according to claim 1, further comprising a pump or a cleaning unit.

11. The downhole tool according to claim 1, wherein the electronic components are mounted on a support that is independent of and spaced from the thermal member on which the transistor elements are supported.

12. The downhole tool according to claim 1, wherein the electronic module and the electronic components are connected to the housing.

13. The downhole tool according to claim 1, further comprising a mount that mounts the electronic module and the electronic components to the housing.

14. A downhole system comprising:

a wireline, a tool string, and a downhole tool according to claim 1.

15. A downhole tool comprising:

a tool housing, and an electronics assembly comprising:

an electronic module located within the housing, wherein the electronics assembly further comprises a plurality of transistor elements being electrically connected with the electronic module and being arranged on a thermal member which is thermally connected with the housing, wherein the electronic module is thermally insulated from the thermal member, and wherein the thermal member further comprises a compartment containing a heat absorption material with a melting point below a critical breakdown temperature of the plurality of transistor elements for providing an extra latent heat of fusion fail-safe protection against temperatures above the melting point of the heat absorption material.

* * * * *